United States Patent [19]

Bachman et al.

[11] Patent Number: 4,817,949

[45] **Date of Patent: * Apr. 4, 1989**

[54] AUTOMATED TELLER MACHINE TRANSACTION RECEIPTS WITH INTEGRAL PROMOTIONAL GAME

[75] Inventors: Gilbert Bachman, Atlanta; Byrne E. Heninger, Marietta, both of Ga.

[73] Assignee: Dittler Brothers, Inc., Atlanta, Ga.

[ * ] Notice: The portion of the term of this patent subsequent to Jun. 9, 2004 has been disclaimed.

[21] Appl. No.: 59,061

[22] Filed: Jun. 8, 1987

Related U.S. Application Data

[63] Continuation-in-part of Ser. No. 741,594, Jun. 5, 1985, Pat. No. 4,671,512.

[51] Int. Cl.[4] ..... A63F 9/00

[52] U.S. Cl. ..... 273/139; 283/101; 283/903

[58] Field of Search ..... 273/139; 283/101, 57, 283/903, 102, 100, 103

[56] References Cited

U.S. PATENT DOCUMENTS

| | | | |
|---|---|---|---|
| 1,011,549 | 12/1911 | Xantis | 283/903 X |
| 4,299,637 | 11/1981 | Oberdeck et al. | 283/103 X |
| 4,671,512 | 6/1987 | Bachman et al. | 273/139 |

*Primary Examiner*—Paul E. Shapiro

*Attorney, Agent, or Firm*—Jones, Askew & Lunsford

[57] ABSTRACT

A receipt stock with integral game to promote the use of automated teller machines (ATMs) by bank customers. The reverse side of the receipt contains playing spaces contiguously disposed along a longitudinal edge of the receipt stock which does not contact the press rollers which convey the receipt through the ATM. Game indicia are printed on the playing spaces, and a protective coating of clear varnish is applied over the indicia. To conceal the game indicia from view until the receipt is distributed to a customer, an opaque masking layer of latex is applied over the playing spaces. The protective coating of varnish prevents the masking layer from penetrating the surface of the paper and thus promotes easy removal of the masking layer by the game player, e.g. by scaping with the edge of a coin. The selective application of the protective coating only to surfaces of the receipt which do not contact the press rollers prevents the receipt stock from slipping when engaged by the rollers. Similarly, the selective positioning of the playing spaces so as not to contact the press rollers prevents the rollers from damaging the latex masking layer and fouling the drive mechanism of the ATM.

5 Claims, 1 Drawing Sheet

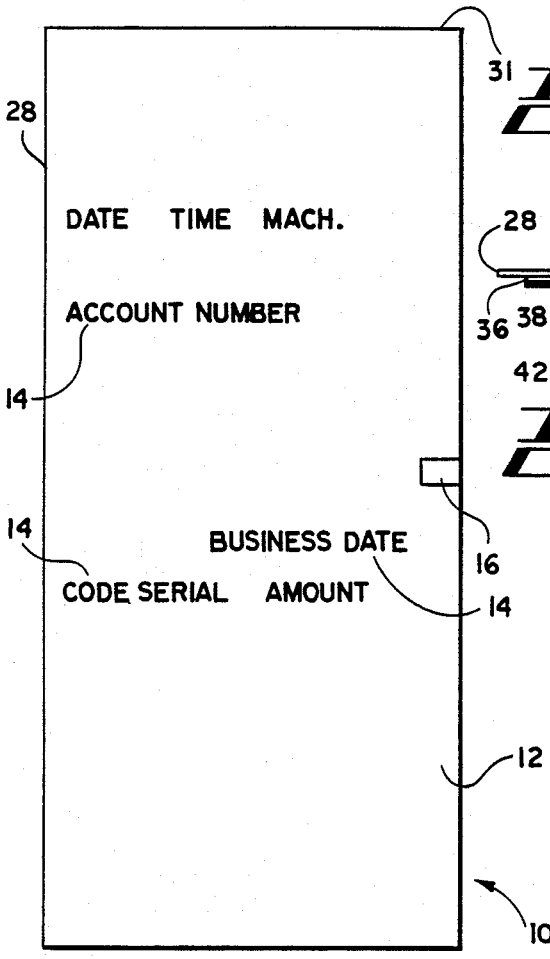
Fig 1
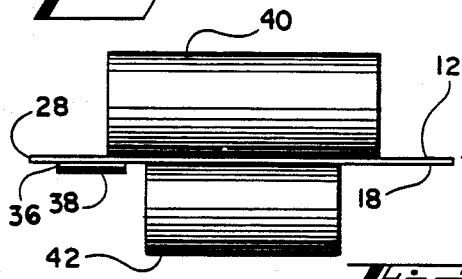
Fig 3
Fig 4
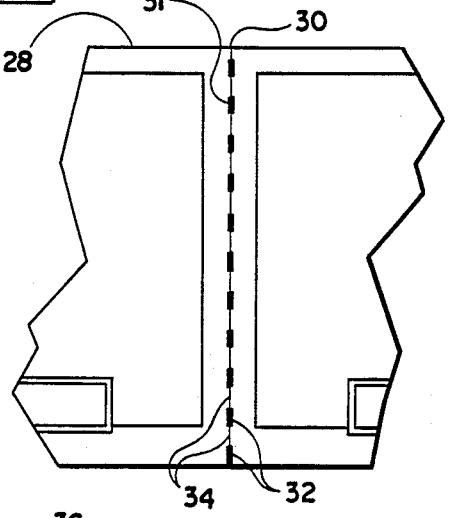
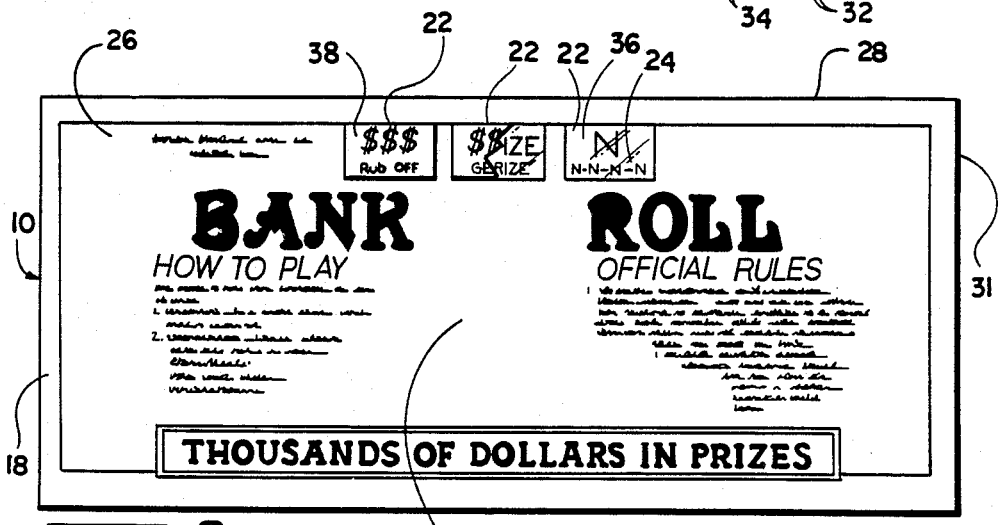
Fig 2

AUTOMATED TELLER MACHINE TRANSACTION RECEIPTS WITH INTEGRAL PROMOTIONAL GAME

This application is a continuation-in-part of application Ser. No. 741,594, filed June 5, 1985, now U.S. Pat. No. 4,671,512.

TECHNICAL FIELD

This invention relates generally to promotional game devices, and relates more specifically to a game which can be incorporated onto the back of customer receipts from automated teller machines without the machine damaging the game and without the game interfering with the operation of the machine.

BACKGROUND OF THE INVENTION

Automated teller machines ("ATMs"), whereby bank customers can make cash withdrawals, deposits, and transfers, are well known. ATMs provide a costeffective and convenient method by which banks can process their customers' transactions. According to a recent article in *The Wall Street Journal,* each transaction costs the bank about 21 cents when transacted through an ATM, compared to 52 cents when a customer uses a teller. In addition, banks can build, or share, thousands of ATMs, where they cannot afford to build a comparable number of branch banks. However, banks have encountered a widespread reluctance on the part of customers to use ATMs. According to *The Wall Street Journal,* only one out of three bank customers uses ATMs. Banks would thus like to encourage the remaining two-thirds of their customers to use the ATMs.

Accordingly, there is a need to provide an incentive for bank customers to utilize automated teller machines.

Throughout the consumer products industry, especially the fast food industry, advertisers and marketing experts have relied heavily on the use of contest games to entice the public to eat in their establishments or to buy their products. In an effort to encourage bank customers to use the ATMs, some banks have placed game indicia, for example a gold star, on random ATM receipts. A bank customer who receives an ATM rceipt bearing a gold star can then redeem his receipt for a prize. However, it would be relatively easy for one having access to the stack of blank ATM receipts to locate the receipts bearing a gold start and to misappropriate the winning receipts, either by theft or by alerting an accomplice as to when the winning receipt will be distributed.

Accordingly, there is a need to provide a promotional game which can be incorporated onto an ATM receipt wherein the game indicia are concealed from view until the bank customer reveals the game indicia when the receipt is distributed.

Promotional games having game indicia concealed from view by readily removable opaque masking material are known in the art. One such popular game utilizes a game card employing a plurality of game indicia printed thereon. The indicia are individually hidden under removable masking layers. The game permits the removal of a given number of masks, such as three. When the masks are removed, typically by rubbing with the edge of a coin, the underlying game indicia are revealed. If the exposed indicia correspond to a desired combination of indicia, the card is a winner and can be redeemed for the appropriate prize. This type of game involves an element of chance in order to produce a winning game card.

Another such game typically employs a game card having a question printed on it, with multiple choice answers provided. Individual indicia concealed by protective masking placed next to each answer indicate whether that answer is correct or incorrect. The contestant selects one answer to the question and removes the masking next to that answer to expose the underlying indicia telling him whether his answer is correct or incorrect. The contestant can select only one answer, and the removal of more than one mask disqualifies the card. This type of game involves an element of skill in order to produce a winning game card.

One such example of game cards having indicia initially concealed by removable masking is disclosed in U.S. Pat. No. 3,918,174, wherein a card is manufactured from a thick sheet of paper having game indicia printed thereon. A thin coating of hard wax or plastic is applied to the face of the card. An opaque ink or wax-like masking is selectively applied to portions of the game card to conceal the game indicia. The coating on the card to conceal the game indicia. The coating on the card prevents the masking material from penetrating into the paper sheet, whereby the masking is readily removable from the card by scraping to expose the underlying game indicia.

Such construction is inconsistent with the requirements for paper adaptable for use as receipts for ATMs. In order for the receipts to be fed through the ATM properly by the pressure rollers used for that purpose, the paper must be uncoated. Otherwise, the paper will slip when engaged by the rollers. However, if an opaque ink or wax-like masking material is applied directly to uncoated paper, the masking will penetrate into the paper and cannot be readily scraped off by the game player to reveal the underlying indicia. In addition, if the masked areas of the game card are contacted by the pressure rollers, the masking may be damaged, revealing the underlying indicia to the recipient or removing the masking from more areas than a player is permitted to remove, thus invalidating the card. Additionally, masking material thus removed by contact with the pressure rollers could foul the printing and drive mechanisms of the ATM.

Another consideration in incorporating such a promotional game onto an ATM receipt is that the game indicia and masking must be imprinted on portions of the receipt which are not normally used by the ATM to print information concerning the transaction. Since ATMs typically print such information over most of the front side of the receipt, this requirement would dictate that the promotional game be printed on the reverse side. However, ATM manufacturers specify that the paper for receipts should be twenty pound stock, a relatively light weight. Using such a lightweight, thin paper, game indicia imprinted on the back of receipt stock would penetrate through the paper and show through on the front side, rendering a receipt printed on the front illegible.

Accordingly, there is a need to provide an ATM receipt having a promotional game thereon which conceals the game indicia until the game is distributed to a customer, wherein the promotional game does not interfere with the proper mechanical functioning of the ATM, wherein the game does not interfere with the customer transaction information printed by the ATM, and wherein the promotional game is not damaged by the ATM.

SUMMARY OF THE INVENTION

As will be seen, the ATM receipt with integral promotional game of the present invention overcomes these and other problems associated with prior art games used to promote the use of ATMs. Stated generally, the promotional game of the present invention comprises an ATM receipt having a front side upon which the ATM imprints information pertaining to the customer transaction, and a plurality of game indicia and instructions for playing the game printed on the reverse side of the receipt stock, with an easily removable opaque masking material concealing the game indicia from view until distributed to a bank customer.

Stated somewhat more specifically, the ATM receipt with integral promotional game of the present invention is printed on heavier paper stock than that specified by the ATM manufacturer. In this manner, the game indicia and playing rules printed on the reverse side of the receipt do not bleed through to the front side where transaction information is printed by the ATM. since the paper stock is heavier, the perforations are also nonstandard, so that the individual sheets tear away from the fan fold stack normally.

In order to conceal the game indicia from view until the receipt is distributed to the customer, the present invention includes a construction which permits applying an easily removable opaque latex masking material over the game indicia. So that the masking material does not interfere with the proper feeding of the receipt stock through the ATM, the game indicia are printed on an area of the stock which s not engaged by the machine's pressure rollers. Coated stock cannot be used in the ATM because it would tend to slip when engaged by the pressure rollers. However, uncoated stock tends to absorb the masking material, preventing it from being easily removed by the contestant. Thus, the present invention uses noncoated stock; and, after the game indicia are imprinted on the reverse side, small areas of a release coating of clear varnish are applied over the game indicia. The opaque latex masking material is then applied over the release coat. In this manner, the latex masking is not absorbed into the paper and can be easily removed by the contestant, for example by rubbing it with the edge of a coin. It has also been found that the concealment of the game indicia with a removable masking makes the game more exciting, inasmuch as it creates a certain degree of suspense and requires involvement on the part of the player to remove the masking.

Thus, it is an object of the present invention to provide an incentive for bank customers to utilize automated teller machines.

It is another object of the present invention to provide a promotional game which can be incorporated onto an ATM receipt.

Another object of the present invention is to provide a promotional game for use on an ATM receipt which requires the involvement and participation of the recipient.

It is a further object of this invention to provide a promotional game which can be incorporated onto an ATM receipt wherein the game indicia are concealed from view until the receipt is distributed to a bank customer.

It is yet another object of this invention to provide an ATM receipt having a promotional game thereon which conceals the game indicia until the game is distributed to a customer, wherein the promotional game does not interfere with the proper functioning of the ATM, and wherein the promotional game is not damaged by the ATM.

Other objects, features, and advantages of the present invention will become apparent upon reading the following specifications when taken in conjunction with the drawings and the appended claims.

BRIEF DESCRIPTION OF THE DRAWINGS

FIG. 1 shows a top view of the ATM receipt of the present invention.

FIG. 2 shows a bottom view of the ATM receipt of the present invention.

FIG. 3 shows a perforated seam between two receipts.

FIG. 4 shows a schematic depiction of an ATM receipt being engaged by the press rollers of an ATM.

DETAILED DESCRIPTION OF THE DISCLOSED EMBODIMENT

Referring now in more detail to the drawing, in which like numerals indicate like elements throughout the several views, FIGS. 1 and 2 show an ATM receipt 10 with integral promotional game. It will be understood that the drawings depict a game designed specifically for use on a Diebold brand ATM, but that the design can be easily adapted for use with other brands of ATMs without departing from the scope and spirit of the appended claims.

FIG. 1 shows the front or obverse surface 12 of the ATM receipt 10, bearing printed heading 14 which identify the transaction information which will be imprinted by the ATM. The exact location of these headings on the page is determined by reference to specifications set by the ATM manufacturer. In addition to the headings 14, a top-of-form sensing mark 16 is provided which will be read by an optical scanner in the ATM to properly register the transaction information printed on the receipt.

FIG. 2 shows the reverse side 18 of the receipt 10 depicting a typical promotional game. Contest rules and instructions for playing the game are printed on the central portion 20 of the lower or reverse side 18. Playing spaces 22 having game indicia 24 printed thereon are disposed along a section 26 of the reverse side contiguous to a longitudinal edge 28 of the receipt 10. Other promotional indicia may be included on the reverse side, as space permits.

The specifications provided by the ATM manufacturer require twenty pound reference weight paper. However, it was found that when game rules and instructions were printed on the central portion of the reverse side of twenty pound paper, the ink would bleed through to the front side of the paper and obscure the transaction information imprinted on the front by the ATM. Accordingly, the receipt 10 of the present invention is constructed of fifty pound reference weight paper stock.

As is customary in the trade, the ATM receipt stock of the present invention can be provided in a continuous fanfold strip. FIG. 3 shows a perforated seam 30 along the adjacent lateral edges 31 of two receipts 10 having perforations 32 and lands 34, the perforations promoting a smooth separation of an individual receipt from the continuous strip. Since heavier paper than that called for by the ATM manufacturer is used, the receipt is thicker than standard. Thus, lands of the same width would be correspondingly thicker and hence stronger, and would not provide the same tear strength as would a standard receipt. Accordingly, in the receipt of the present invention fewer and narrower lands are provided in comparison to standard receipt stock in order to maintain a comparable tear strength. The perforated seam of the present invention comprise eight perforations per inch with lands 0.025 inches wide.

It will be appreciated by those skilled in the art that the receipt of the present invention is not limited to the continuous fanfold format hereinbefore described, and that it can be readily adapted for use on automated teller machines, such as those currently manufactured by International Business Machines, Inc., which employ stacks of individual receipts rather than a continuous fanfold strip.

If the game indicia 24 were exposed to view prior to being distributed to a customer, it would be relatively easy for one having access to the blank receipt stock to locate the winning receipts and misappropriate them. Additionally, it has been found that contestants experience a sense of drama and involvement when they are required to participate actively by removing a protective masking to reveal the underlying game indicia. Accordingly, it is desirable to conceal the game indicia from view until the receipt is distributed.

In order to conceal the game indicia 24 from view until the contestant receives the ATM receipt, the playing spaces 22 with game indicia 24 printed thereon are first covered with a release coating 36 of clear varnish through which the game indicia can be viewed. Next, an opaque masking layer 38 of latex is applied over the varnish to conceal the indicia 24 from view. The release coating 36 prevents the masking layer 38 from penetrating the paper stock. As a result, the masking layer 38 is easily removable, such as by rubbing with the edge of a coin, to reveal the underlying game indicia 24. The protective release coating 36 of varnish also prevents the underlying indicia 24 from being damaged in the process of removing the masking layer 38.

FIG. 4 shows a schematic representation of a receipt 10 being pulled through an ATM by upper and lower press rollers 40, 42. As will be appreciated by those skilled in the art, the lower press roller 42 engages only the central longitudinal portion 20 of the reverse side 18, and the lower roller never contacts the longitudinal edge section 26 upon which the indicia 24 are printed. It will be appreciated that, in order for the press rollers 40, 42 to pull the receipt 10 through the ATM without slipping, the paper stock must be uncoated. Therefore, it is important to restrict the release coating 36 of varnish to the edge section 26 which is not contacted by the press rollers.

Similarly, if the press rollers 40, 42 of the ATM were to come into contact with the latex masking layer 38, the rollers could become fouled with latex and cause the rollers to slip. Alternatively, the rollers could potentially damage the masking layer 38 if they came into contact. Such damage could reveal the underlying game indicia 24, and, depending on the type of promotional game, either reveal a solution to the game or render the game unplayable. Again, therefore, it is important to restrict the masking layer 38 of latex to the edge section 26 which is not contacted by the press rollers.

The promotional game of the present invention comprises three playing spaces 22 having game indicia 24 concealed by a protective masking layer 38. The game indicia 24 comprise either prize indicia, e.g. "1st PRIZE", or letter incidia from the group "W", "I", "N", "E", or "R". When the contestant removes the masking 38 from the playing spaces 22 to reveal the underlying indicia 24, there are two different ways in which he can win: either by matching the same prize indicia in all three playing spaces of the same receipt to become an "instant winner", or by collecting a plurality of receipts to collect all of the letters necessary to spell the word "W-I-N-N-E-R". Thus, each time a contestant receives a receipt, he has the opportunity to be an "instant winner", or he can combine a number of receipts to spell "W-I-N-N-E-R" and win a prize. In this manner, the contestant is encouraged to use the ATM for future transactions.

While the game of the present invention comprises a game of chance, it will be appreciated that other games of chance may be incorporated into an ATM transaction receipt, as well as games requiring skill on the part of the contestant to win the game.

To manufacture the ATM receipt of the present invention, a fanfold stack of fifty pound reference weight receipt stock is provided. Transaction headings 14 and the top of form sensing mark 16 are imprinted on the obverse side 12 of the receipt stock using conventional means such as a web offset printing press. Similarly, game rules and instructions are printed on the central portion 20 of the reverse side 18 of the receipt stock, and game indicia 24 are printed on each of the playing spaces 22 contiguously disposed along a longitudinal edge 28 of the reverse side of the receipt stock.

After the obverse and reverse sides have been printed, the receipt stock is passed through a gravure press where a coating 36 of clear varnish is applied over each playing space 22, being careful to restrict the varnish to the section 26 contiguous to the longitudinal edge 28 which will not be contacted by the bottom press roller 42 of the ATM. Another gravure press next applies an opaque masking layer 38 of latex over each playing space 22, thereby obscuring the underlying game indicia 22 printed thereon.

Finally, the receipt stock is conveyed through a conventional perforation and slitting unit, whereby the seams 30 at the lateral edge 31 between fanfolds are perforated to promote the smooth separation of an individual receipt from the fanfold receipt stock. Eight perforations 32 per inch are slit into the paper, leaving lands 34 0.025 inches wide.

To use the ATM receipt of the instant invention, the stock is loaded into an ATM in the conventional manner. As a customer transacts his banking business via the ATM, a computer actuated print head within the ATM prints information pertaining to the transaction. An optical scanner in the ATM detects the top of form sensing mark 16 on the obverse side 12 of the receipt 10 and provides for proper registration of the transaction information with respect to the appropriate preprinted headings 14 on the obverse of the receipt. At the conclusion of the transaction, the customer removes the receipt from the ATM by tearing along the perforated seam 30 at the lateral edge 31 of the receipt.

After completing the transaction and receiving the transaction receipt, the customer can play the integral promotional game on the reverse side 18 of the receipt. After reading the game rules and instructions imprinted on the central portion 20 of the reverse side, the customer removes the opaque masking layer 38, e.g. by scraping with the edge of a coin. The protective layer 36 of clear varnish underneath the masking layer 38 promotes easy removal of the latex masking layer and protects the underlying game indicia 24.

When the masking has been removed, the game indicia are revealed. If the game indicia in all three playing spaces match, the customer is an "instant winner". Otherwise, the customer can collect a number of ATM receipts to accumulate enough letters to spell the word "W-I-N-N-E-R" to win a prize. In this manner, the customer is encouraged to use the ATM for future transactions, in hope of acquiring the remaining letters needed to win the game.

In order to prevent a person having access to blank receipt stock from misappropriating a large quantity of stock and thereby acquiring winning receipts, it may be desirable for security reasons to require that all winning tickets have been acquired from an automated teller machine. Accordingly, a bank sponsoring the game of the present invention can require that all games be validated by the presence of customer transaction information imprinted by the ATM on the obverse side of the receipt. Any game receipt not having transaction information imprinted thereon would be disqualified as having been improperly acquired.

Finally, it will be understood that the preferred embodiment of the present invention has been disclosed by way of example, and that other modifications may occur to those skilled in the art without departing from the scope and spirit of the appended claims.

What is claimed is:

1. An apparatus comprising, in combination:

a transaction receipt having obverse and reverse surfaces;

an automated teller machine which prints transaction information on said obverse surface of said transaction receipt, said automated teller machine having a friction drive element which engages portions of one of said obverse or reverse surfaces of said receipt for conveying said receipt through said automated teller machine, and said automated teller machine further having a biasing element which engages portions of the other of said obverse and reverse surfaces of said receipt for biasing said receipt against said obverse and reverse surfaces of said receipt for biasing said receipt against said friction drive element;

said transaction receipt further comprising:

paper stock having non-smooth obverse and reverse surfaces such that said receipt will not slip when engaged by said friction drive element of said automated teller machine;

game indicia imprinted on a portion of said reverse surface of said paper stock which is not contacted by said other of said friction drive element and said biasing element which engages portions of said reverse surface of said receipt;

a release coating applied over said game indicia, whereby said game indicia may be viewed through said release coating; and a selectively removable opaque masking applied over said release coating such that said masking does not penetrate said reverse surface of said paper stock, whereby said game indicia are concealed from view until said masking is removed.

2. The apparatus of claim 1, wherein said friction drive element which engages portions of one of said obverse or reverse surfaces of said receipt for conveying said receipt through said automated teller machine comprises a pressure roller.

3. The apparatus of claim 1, wherein said biasing element which engages portions of the other said obverse and reverse surfaces of said receipt for biasing said receipt against said friction drive element comprises a pressure roller.

4. The apparatus of claim 1, wherein said release coating comprises a clear varnish.

5. The apparatus of claim 1, wherein said opaque masking comprises latex.

* * * * *